United States Patent [19]

Rosso

[11] Patent Number: 4,885,886

[45] Date of Patent: Dec. 12, 1989

[54] NONSETTLING INSULATION STRUCTURE

[76] Inventor: Charles Rosso, Box 187, Cimarron, N. Mex. 87714

[21] Appl. No.: 246,635

[22] Filed: Sep. 19, 1988

[51] Int. Cl.[4] ..... E04B 2/00; E04B 1/62

[52] U.S. Cl. ..... 52/404; 428/140; 52/454

[58] Field of Search ..... 52/404, 406, 407, 762, 52/145, 408, 454; 428/285, 282, 288, 287, 133, 284, 140

[56] References Cited

U.S. PATENT DOCUMENTS

| | | | |
|---|---|---|---|
| 1,148,447 | 7/1915 | Eh et . | |
| 1,815,921 | 7/1931 | Liapof | 52/408 |
| 1,915,611 | 6/1933 | Miller | 428/133 |
| 1,924,515 | 4/1931 | Reinke . | |
| 2,009,619 | 7/1935 | Huffine | 52/407 |
| 2,030,157 | 2/1936 | Schlenker | 52/144 |
| 2,055,032 | 9/1936 | Johnson | 428/140 |
| 2,271,929 | 2/1942 | Venzie | 52/145 |
| 2,726,977 | 12/1955 | See | 52/145 |
| 2,745,779 | 5/1956 | Ritter | 428/140 |
| 2,780,090 | 2/1957 | Rasmussen . | |
| 2,785,099 | 3/1957 | Holtsford | 52/408 |
| 3,209,502 | 10/1965 | Donegan | 52/408 |
| 3,879,910 | 4/1975 | Waite | 52/145 |
| 3,905,855 | 9/1975 | Blewett | 428/285 |
| 3,934,382 | 1/1976 | Gartung | 52/144 |
| 4,228,624 | 10/1980 | Reneault | 52/145 |
| 4,236,361 | 12/1980 | Boden . | |
| 4,696,138 | 9/1987 | Bullock | 52/407 |
| 4,700,521 | 10/1987 | Cover | 52/404 |
| 4,784,891 | 11/1988 | Shickel | 428/284 |

FOREIGN PATENT DOCUMENTS

| | | |
|---|---|---|
| 2554847 | 5/1985 | France . |

*Primary Examiner*—John E. Murtagh

*Attorney, Agent, or Firm*—Deborah A. Peacock; Robert W. Weig

[57] ABSTRACT

The disclosure is directed to a nonsettling insulation structure comprising a central support member having a layer of insulative material adhered to each side of the central support member.

8 Claims, 2 Drawing Sheets

NONSETTLING INSULATION STRUCTURE

FIELD OF THE INVENTION

The invention relates to nonsettling insulation structures and more particularly to fiber insulation structures constructed to eliminate settling of the fibers over time.

BACKGROUND OF THE INVENTION

There has been a long-standing need for retaining fiber insulation in place in residential and commercial buildings, mobile homes, and the like. Blown-in insulation, in particular, settles, leaving an air space and, for example, no insulation at the top portion of walls. Other insulation batts are not self-supporting and tend to settle over time from their own weight, from vibration caused by winds, the activities of building occupants, as well as from water when the batts get wet from leaks and condensation, and the like. FIG. 1 is directed to a typical prior art insulation installation which has settled because of one or all of the aforementioned reasons. As seen therein, insulation 12 between studs 10 has settled to leave space 14 of wall 16 above the top of insulation 12. Since insulation settling removes insulation from the higher portions of a building wall and heat rises, a great deal of heat loss occurs from such settling. It has been shown that as much as one third of heat loss from an average residence where insulation settling has occurred is due to such settling.

Over the years, many solutions have been attempted to prevent settling of the insulation. One such solution is disclosed in French Pat. No. 2,554,847 to Blandin, et al. As shown therein, fibers coated with an adhesive are blown into two parallel spaces A and R, separated by an impermeable partition 16. Air permeable inner and outer sheets 17 and 18 enclose the spaces and are affixed to the surfaces of spaced vertical supports. Internal partition 16 is affixed to additional internal support members 10 and 11. This structure appears to be effective, although the bulk of the blown-in insulation no doubt collects toward the bottom of the structure. A large amount of adhesive must be used since all fibers are coated with it. Extra support elements 10 and 11 are required. Construction of this structure, considering materials and labor, is expensive.

U.S. Pat. Nos. 2,780,090, entitled INSULATING STRUCTURE, to Rasmussen, and 4,236,361, entitled PREFABRICATED BUILDING COMPONENTS, to Boden, disclose the use of wire screens to reinforce insulating materials such as foams. U.S. Pat. No. 1,924,515, entitled BUILDING WALL CONSTRUCTION, to Reinke, discloses a insulating material having flanges designed to be tacked to wall studs. U.S. Pat. No. 1,148,447, entitled INSULATING FELT, to Ehret, discloses an insulating felt reinforced with a textile material.

It is apparent that retaining insulation in place on a vertical wall is a long-standing problem and that a simple and inexpensive solution is needed.

SUMMARY OF THE INVENTION

In accordance with the present invention, there is provided a nonsettling insulation structure comprising a support member comprising a sheet of semi-rigid material having two sides, a first layer of insulative material attached to one side of the sheet of semi-rigid material, and a second layer of insulative material attached to the other side of the sheet of semi-rigid material. The layers of insulative material are preferably attachable to the sheet of semi-rigid material by a adhesive disposed on the sheet.

The support member preferably comprises a sheet of nonmetallic material which is perforated or permeable. This sheet is preferably easily cuttable, such as with snips. One or both layers of insulative material preferably comprise a fiber insulation material, and most preferably comprise fiberglass.

The support member preferably comprises a generally rectangular sheet having a predetermined width and two longitudinal sides having flanges disposed thereon for positioning and fastening the nonsettling insulation structure between parallel studs positioned apart to approximately the predetermined width. The flanges preferably have L-shaped cross sections, so that the nonsettling insulation structure is affixable between the parallel studs at a preselected depth therebetween. The flanges are preferably affixable to the parallel studs by positioning fasteners such a nails or staples through L-base portions of the L-shaped cross sections.

One object of the present invention is to retain insulation, particularly fiber insulation in place.

Another object of the present invention is to provide inexpensive, secure fiber insulation.

One advantage of the present invention is that in accordance therewith, insulation can be easily and effectively secured by unskilled labor.

Another advantage of the instant invention is that heating and cooling costs of a building built therewith are lower than if built with conventional insulation installation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention.

In the drawings.

DETAILED DESCRIPTION OF A PREFERRED EMBODIMENT OF THE INVENTION

Figure 1:
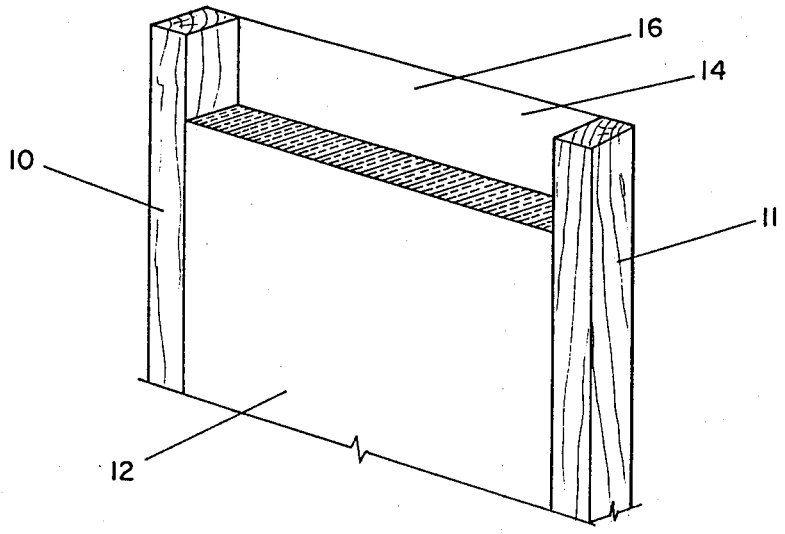
FIG-1 PRIOR ART
FIG. 1 depicts a typical prior insulation installation.
Figure 2:
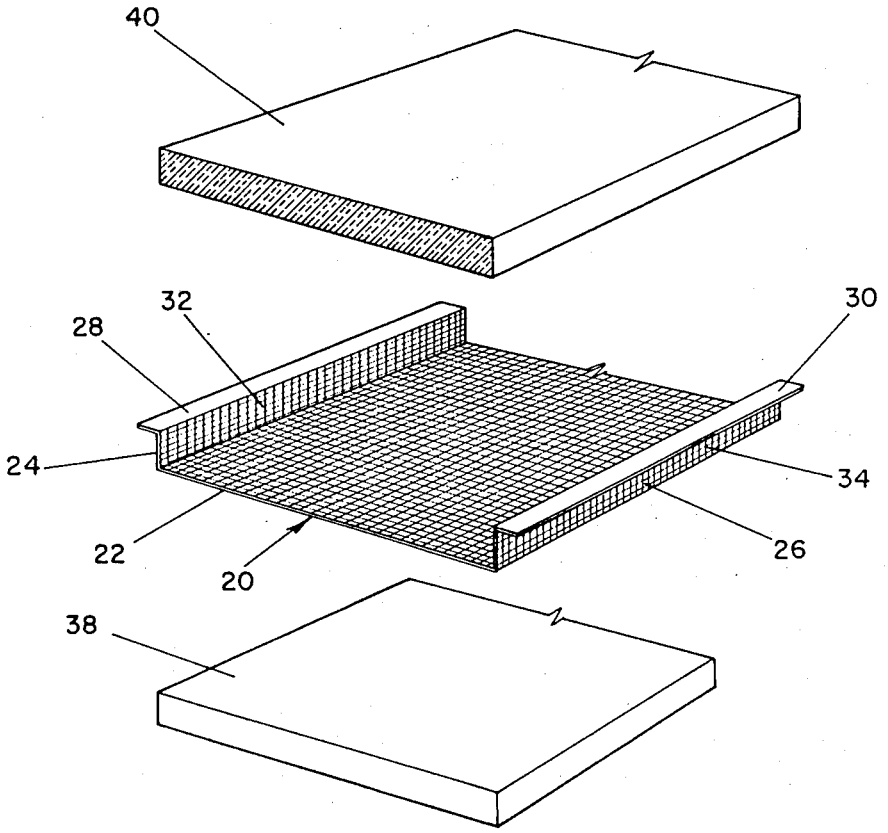
FIG. 2 shows an exploded view of a preferred embodiment of the invention which comprises an insulating support member and layers of insulation.

Reference is now made to FIG. 2 which shows an exploded view of a preferred embodiment of the invention. As seen therein, a support member 20 comprises a sheet of semi-rigid material 22 having two flanges 24 and 26. The term "semi-rigid" as used throughout the specification and claims is intended to include any rigid or semi-rigid material which is capable of supporting at least two layers of insulative material. The support member is preferably formed from a perforated or permeable nonmetallic material such as fiberglass or plastic, but those skilled in the art will appreciate that other materials having suitable characteristics, such as thin perforated sheet metal, can also be employed. The semi-rigid material is preferably chosen to be easily cuttable with snips which are commonly available for cutting thin sheet metal and the like. The sheet 22 is preferably generally rectangular and flanges 24 and 26 are disposed along its longitudinal sides. Sheet 22 and flanges 24 and 26 are preferably formed from a single body of material. Flanges 24 and 26 in the preferred embodiment are L-shaped in cross section and comprise L-bases 28 and 30 and L-stems 32 and 34, respectively (see FIG. 2). The sheet 22 is coated on both sides with an adhesive and layers of insulative material 38 and 40 are applied thereto.

In accordance with the invention, support member 20 can comprise a sheet having no flanges, a sheet having simple flanges perpendicular thereto, or a sheet having side lips or other reinforcement, for rigidity. However, the particular L-shaped flange of the preferred embodiment, shown in the drawings (see FIG. 2), lends itself to an easy installation with nails, staples, tacks, and the like, by an unskilled laborer.

Figure 3:
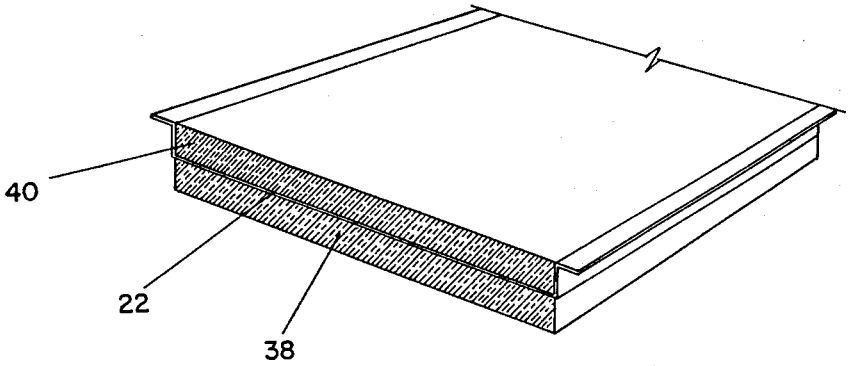
FIG. 3 illustrates the preferred embodiment of FIG. 2 as assembled.
Figure 4:
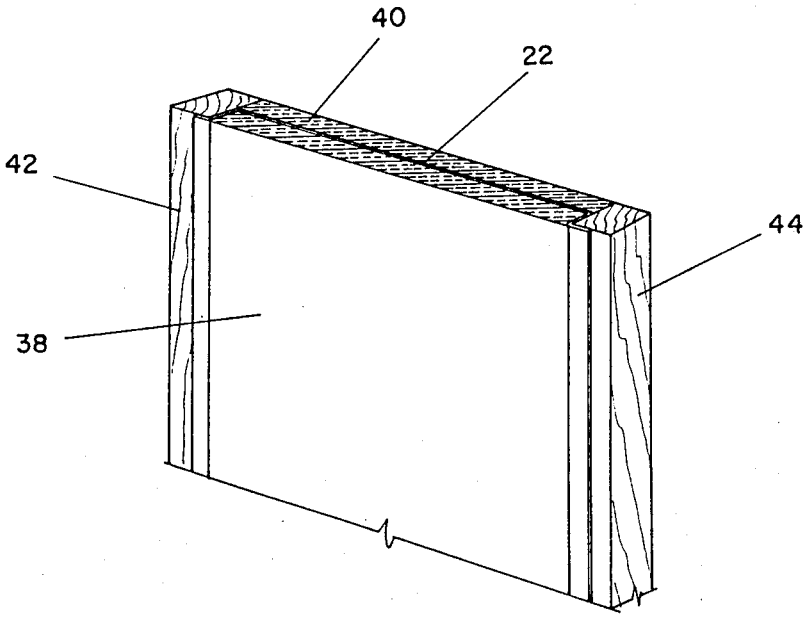
FIG. 4 shows the preferred embodiment of FIGS. 2 and 3 in place between two studs.

FIG. 3 shows the preferred embodiment of the invention with insulating layers 38 and 40 in place on the sheet 22. FIG. 4 shows the preferred embodiment in place between two studs 42 and 44. The adhesive coatings on each side of sheet 22 hold the layers of insulation 38 and 40 in position thereon and the semi-rigid nature of support member 20 holds the fiber insulation upright between studs 42 and 44. The preferred embodiment is manufactured to predetermined widths which correspond to stud spacing so that the preferred embodiment can be nailed, stapled, or otherwise fastened between studs. Such widths could be, by way of example, conventional widths used in the framing trade, such as 16" and 24". The preferred embodiment is snipped to suitable length and fits snugly between studs, tightly insulating the building or structure of which it is made a part.

The insulating layers 38 and 40 preferably comprise fiberglass, rock wool, or other forms of insulative materials. Those skilled in the art will recognize that any suitable fiber or other form of insulative material can be used and that the invention is not limited to a particular form of insulating material. Likewise, the invention is not limited to any number of layers of insulation. The layers of insulation 38 and 40 act as one layer in the preferred embodiment because sheet 22 is preferably permeable or perforated; thus, there is no vapor barrier between the layers 38 and 40 and the sheet 22.

The invention has been described in detail with particular reference to a preferred embodiment thereof, but it will be understood that variations and modifications can be effected within the scope of the invention.

What is claimed is:

1. For use in a wall with a substantially vertical component, a nonsettling insulation structure comprising:

a support member comprising a sheet of semi-rigid permeable material having two sides and being easily cuttable;

a first layer of otherwise unsupported fibrous insulative material attached to one side of said sheet of semi-rigid permeable material;

a second layer of otherwise unsupported fibrous insulative material attached to the other side of said sheet of semi-rigid permeable material;

wherein said support member is capable of supporting and preventing settling of said first layer and said second layer of insulative material in the wall with the substantially vertical component;

wherein said support member comprises a generally rectangular sheet having a predetermined width and two longitudinal sides, said sides having thereon flange means for positioning and fastening said nonsettling insulation structure between parallel studs in the substantially vertical wall, and said flange means being positioned apart to approximate the width between such parallel studs; and wherein said flange means comprise L-shaped cross sections, whereby said nonsettling insulation structure is affixable between the parallel studs at a preselected depth therebetween.

2. The invention of claim 1 wherein said support member comprises a sheet of nonmetallic material.

3. The invention of claim 1 wherein said support member comprises a perforated sheet.

4. The invention of claim 1 wherein said fibrous insulative material comprises fiberglass.

5. The invention of claim 1 wherein said layers of insulative material are attached to said sheet of semi-rigid permeable material by adhesive means.

6. The invention of claim 1 wherein said adhesive means are disposed on both sides of said sheet of semi-rigid permeable material.

7. The invention of claim 1 wherein said flange means are affixable to the parallel studs by positioning fasteners through L-shaped base portions of said L-shaped cross sections.

8. The invention of claim 1 wherein said support member is cuttable with snips.

* * * * *